US009324284B2

(12) United States Patent
Kim et al.

(10) Patent No.: US 9,324,284 B2
(45) Date of Patent: Apr. 26, 2016

(54) LIQUID CRYSTAL DISPLAY DEVICE COMPENSATING FOR COMMON VOLTAGE AND METHOD OF DRIVING THE SAME

(71) Applicant: LG DISPLAY CO., LTD., Seoul (KR)

(72) Inventors: Kyung-Rok Kim, Paju-si (KR); Yong-Won Jo, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 181 days.

(21) Appl. No.: 13/728,780

(22) Filed: Dec. 27, 2012

(65) Prior Publication Data

US 2014/0092077 A1 Apr. 3, 2014

(51) Int. Cl.
*G09G 5/00* (2006.01)
*G09G 3/36* (2006.01)

(52) U.S. Cl.
CPC ..... *G09G 3/3611* (2013.01); *G09G 3/3655* (2013.01); *G09G 3/3614* (2013.01)

(58) Field of Classification Search
None
See application file for complete search history.

(56) References Cited

U.S. PATENT DOCUMENTS

2008/0158221 A1* 7/2008 Guan et al. ..... 345/214
2009/0109293 A1* 4/2009 Coley et al. ..... 348/181
2009/0244109 A1* 10/2009 Chen et al. ..... 345/690
2011/0102404 A1* 5/2011 Hou ..... G09G 3/3614 345/211
2012/0169694 A1* 7/2012 Chuang et al. ..... 345/211
2012/0242641 A1* 9/2012 Lee ..... G09G 3/3655 345/212
2012/0299895 A1* 11/2012 Lin et al. ..... 345/211

FOREIGN PATENT DOCUMENTS

CN 102243849 A 11/2011

* cited by examiner

*Primary Examiner* — Dorothy Harris
*Assistant Examiner* — Bipin Gyawali
(74) *Attorney, Agent, or Firm* — Birch, Stewart, Kolasch & Birch, LLP

(57) ABSTRACT

There is provided a driving method of a liquid crystal display device that is driven by an inversion method, including: calculating a total sum of changed amounts of data voltages between an (n−1)-th row line and an n-th row line, using image data of the (n−1)-th row line and image data of the n-th row line; generating common voltage data according to the total sum of the changed amounts of the data voltages; compensating for the common voltage data using a characteristic parameter of a liquid crystal panel; and generating a common voltage according to the compensated common voltage data, and outputting the common voltage to the liquid crystal panel.

14 Claims, 5 Drawing Sheets

LIQUID CRYSTAL DISPLAY DEVICE COMPENSATING FOR COMMON VOLTAGE AND METHOD OF DRIVING THE SAME

The present application claims the priority benefit of Korean Patent Application No. 10-2012-0108873 filed in the Republic of Korea on Sep. 28, 2012, which is hereby incorporated by reference in their entirety.

BACKGROUND

1. Field of the Disclosure

The present disclosure relates to a liquid crystal display device, and more particularly, to a liquid crystal display device and a method of driving the same.

2. Discussion of the Related Art

With the development of information society, demands for display devices for displaying images are increasing in various forms. In order to meet the demands, various flat display devices, such as a liquid crystal display (LCD), a plasma display panel (PDP), and an electro luminescent display (ELD), have been developed and used.

Among the flat display devices, the liquid crystal display device has been widely used since it can be manufactured as a slim, thin, light-weighted display having low power consumption.

Nowadays, an active matrix type liquid crystal display device is widely used in which a switching transistor is formed in each of pixels arranged in a matrix form.

The liquid crystal display device is driven generally by an inversion driving method in order to prevent DC stress from being generated in liquid crystal. Among various inversion driving methods, a dot inversion method of inverting polarity in units of pixel, and a line inversion method of inverting polarity in units of row line are generally used.

If a liquid crystal display device is driven by an inversion driving method, the polarity of a data voltage charged to entire data lines may change every horizontal period. Meanwhile, parasitic capacitance is generated between common lines and data lines due to coupling.

Accordingly, if the data voltage changes every horizontal period, common voltage ripples are caused in which a common voltage changes every horizontal period. Particularly, the common voltage ripples are significant when the line inversion method in which polarity is inverted in units of row line, is used.

The common voltage ripples cause the deterioration of image quality, such as crosstalk or smear.

In order to minimize the deterioration of image quality, a method of receiving a common voltage fed back from a liquid crystal panel and using an inverting OP amplifier to output a voltage that is opposite to a common voltage ripple component to thereby compensate for the common voltage, has been proposed.

However, the method does not supply a sufficient, inverted voltage at a gate voltage off timing at which the deterioration of image quality occurs, and accordingly the method has failed to fundamentally eliminate the cause of image quality deterioration.

SUMMARY OF THE INVENTION

Accordingly, the present invention is directed to a display device that substantially obviates one or more of the problems due to limitations and disadvantages of the related art.

An object of the present disclosure is to provide a method capable of effectively improving the deterioration of image quality due to common voltage ripples.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, there is provided a driving method of a liquid crystal display device that is driven by an inversion method, including: calculating a total sum of changed amounts of data voltages between an (n−1)-th row line and an n-th row line, using image data of the (n−1)-th row line and image data of the n-th row line; generating common voltage data according to the total sum of the changed amounts of the data voltages; compensating for the common voltage data using a characteristic parameter of a liquid crystal panel; and generating a common voltage according to the compensated common voltage data, and outputting the common voltage to the liquid crystal panel.

In another aspect, there is provided a liquid crystal display device which is driven by an inversion method, including: an operation block configured to calculate a total sum of changed amounts of data voltages between an (n−1)-th row line and an n-th row line, using image data of the (n−1)-th and n-th row lines, to generate common voltage data according to the total sum of the changed amounts of the data voltages, and to compensate for the common voltage data using a characteristic parameter of a liquid crystal panel; a characteristic parameter block configured to supply the characteristic parameter to the operation block; and a common voltage generator configured to generate a common voltage according to the compensated common voltage data, and to output the common voltage to the liquid crystal panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments, examples of which are illustrated in the accompanying drawings.

Figure 1:
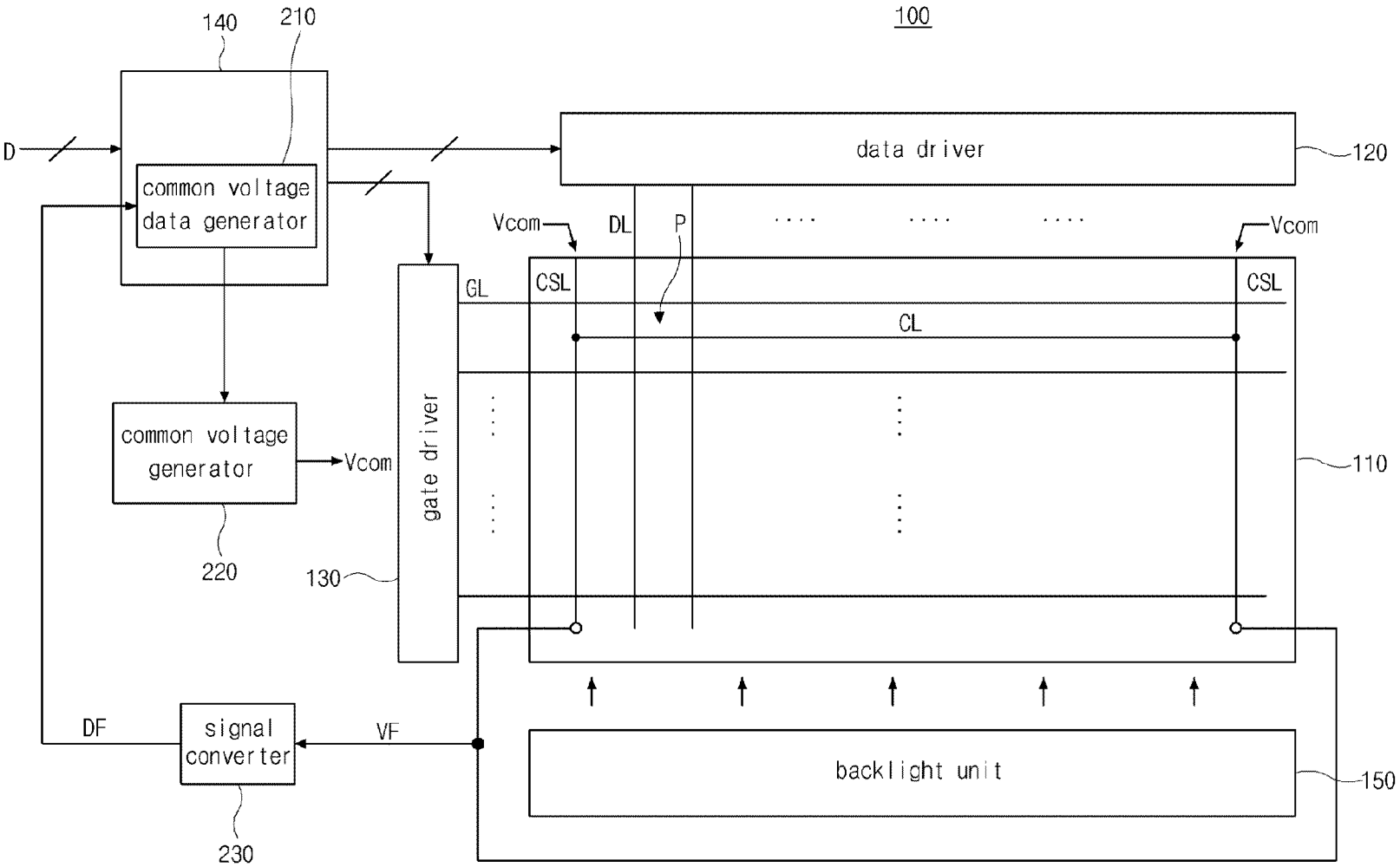
FIG. 1 is a block diagram schematically showing a liquid crystal display device according to an embodiment of the present invention.
Figure 2:
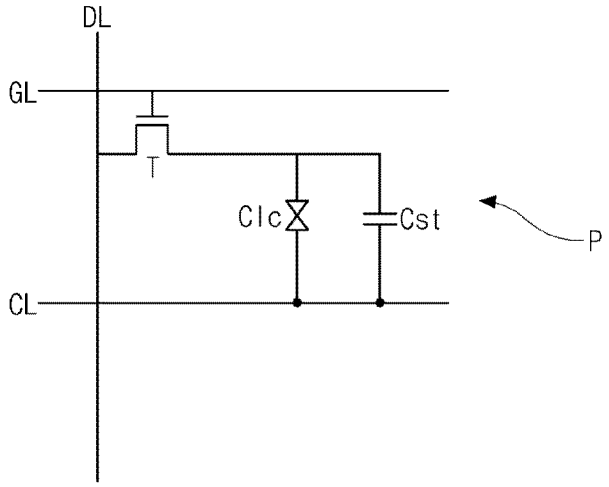
FIG. 2 is a circuit diagram schematically showing each pixel of the liquid crystal display device, according to an embodiment of the present invention.
Figure 3:
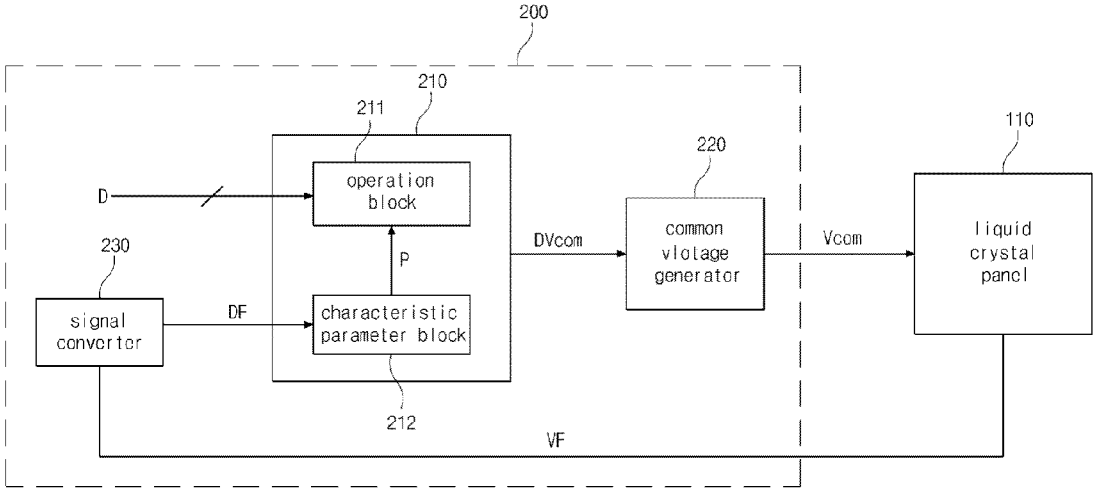
FIG. 3 is a block diagram schematically showing a common voltage unit according to an embodiment of the present invention.

FIG. 1 is a block diagram schematically showing a liquid crystal display device 100 according to an embodiment of the present invention, FIG. 2 is a circuit diagram schematically showing each pixel of the liquid crystal display device 100, according to an embodiment of the present invention, and FIG. 3 is a block diagram schematically showing a common voltage unit according to an embodiment of the present invention.

Referring to FIGS. 1, 2, and 3, the liquid crystal display device 100 may include a liquid panel 110, a driving circuit, and a backlight unit 150.

The liquid crystal panel 110 includes an array substrate, an opposite substrate facing the array substrate, and a liquid crystal layer, wherein the opposite substrate may be a color filter substrate.

In the liquid crystal panel 110, a display area and a non-display area surrounding the display area are defined. In the display area, a plurality of pixels P are arranged in a matrix form to display an image.

In the array substrate of the liquid crystal panel 110, a plurality of gate lines GL are arranged in a first direction, for example, in a row line direction, and a plurality of data lines DL are arranged in a second direction crossing the first direction, for example, in a column line direction.

Meanwhile, in the non-display area portion neighboring at least one side of the display area of the array substrate, a common supply line CSL may be formed. Also, a plurality of common lines CL may be connected to the common supply line CSL and extend across the display area. The individual common lines CL are arranged in parallel to the gate lines GL while being spaced apart from the individual gate lines GL. A common voltage Vcom input to the liquid crystal panel 110 may be transferred to the pixels P positioned on the display area through the common supply line CSL and the common lines CL.

The gate lines GL and the data lines DL are connected to the corresponding pixels P. The pixels P may include red (R) pixels for representing a red color, green (G) pixels for representing a green color, and blue (B) pixels for representing a blue color. For example, the R, G, and B pixels may be arranged alternately in the row line direction, and consecutive R, G, and B pixels may function as a unit for image representation.

Each pixel P includes a switching transistor T connected to a gate line GL and a data line DL, and a liquid crystal capacitor Clc connected to the switching transistor T. The liquid crystal capacitor Clc is composed of a pixel electrode, a common electrode, and a liquid crystal layer interposed between the pixel electrode and the common electrode.

Also, the pixel P may include a storage capacitor Cst for storing a data voltage applied to the liquid crystal capacitor Clc.

The switching transistor T is turned on according to a gate voltage applied through the gate line GL, and when the switching transistor T is turned on, a data voltage is applied to the pixel P through the data line DL. As such, the liquid crystal of the pixel P is driven according to an electric field generated by the data voltage and the common voltage Vcom applied to the common electrode, thereby displaying an image.

The liquid panel 110 as described above is driven by an inversion method. For example, the liquid panel 110 may be driven by various inversion methods, such as a dot inversion method, a line inversion method, a Z inversion method, etc.

In regard of the Z inversion method, pixels P are arranged alternately at both sides of each data line in units of a row line in the extending direction of the data line DL. In this structure, the same polarity of signal is applied to each data line DL for a frame, and the polarity of signal changes every frame, so that a polarity pattern such as dot inversion may appear on the entire liquid panel 110.

The driving circuit for driving the liquid crystal panel 110 may include a data driver 120, a gate driver 130, a timing controller 140, and a common voltage unit 200 (see FIG. 3).

The timing controller 140 may receive an external timing signal, such as a vertical/horizontal synchronization signal, a data enable signal, a dot clock, etc., from an external system, through an interface, such as a Low Voltage Differential Signaling (LVDS) interface, a Transition Minimized Differential Signaling (TMDS) interface, etc.

The timing controller 140 may use the timing signal to generate a data control signal for controlling the data driver 120, and a gate control signal for controlling the gate driver 130.

The data control signal may include a source start pulse, a source sampling clock, a polarity control signal, a source output enable signal, etc. Also, the gate control signal may include a gate start pulse, a gate shift clock, a gate output enable signal, etc.

Meanwhile, the timing controller 140 receives image data D from the external system, processes the image data D, and supplies the results of the processing to the data driver 120.

The data driver 120 may be configured with at least one driving IC. The driving IC may be connected to the liquid crystal panel 110 through a Chip On Glass (COG) process or a Chip On Film (COF) process, etc., and connected to the corresponding data line DL.

The data driver 120 receives digital image data D and a data control signal output from the timing controller 140, and outputs an analog data voltage to the corresponding data line DL in response to the digital image data D and the data control signal. For example, the data driver 120 may convert received image data into image data in parallel form according to a data control signal, then converts the image data in parallel form into a positive/negative data voltage, and outputs the positive/negative data voltage to the corresponding data line DL.

The backlight unit 150 functions as a light source of the liquid crystal panel 110. Various kinds of light sources may be used as the backlight unit 150. For example, the backlight unit 150 may be a cold cathode fluorescent lamp (CCFL), an external electrode fluorescent lamp (EEFL), a light-emitting diode (LED), etc.

The common voltage unit 200 generates the common voltage Vcom, and supplies the common voltage Vcom to the liquid crystal panel 110. The common voltage Vcom is supplied to the pixels P through the common supply line CSL and the common lines CL.

Hereinafter, the common voltage unit 200 will be described in more detail with reference to FIG. 3.

The common voltage unit 200 may include a common voltage data generator 210, a common voltage generator 220, and a signal converter 230.

The common voltage generator 220 generates a common voltage Vcom according to common voltage data DVcom output from the common voltage data generator 210. The common voltage generator 220 may be configured in a power supply circuit of the liquid crystal display device 100 (see FIG. 1).

Signal transfer between the common voltage generator 220 and the common voltage data generator 210 may be performed, for example, through I2C communication.

The signal converter 230 receives a feedback signal VF of the common voltage Vcom from the liquid crystal panel 110, that is, an analog feedback voltage VF, and converts the analog feedback signal VF to a digital feedback signal DF. That is, the signal converter 230 may be an analog-to-digital converter (ADC). The digital feedback signal DF is input to the common voltage data generator 210.

The common voltage data generator 210 receives image data D and the feedback signal DF, and generates common voltage data DVcom based on the image data D and the feedback signal DF. The common voltage data generator 210 may be configured in the timing controller 140 (see FIG. 1), however, the common voltage data generator 210 may be configured outside the timing controller 140.

The common voltage data generator 210 may include an operation block 211 and a characteristic parameter block 212.

The operation block 211 may generate the common voltage data DVcom using the received image data D and a characteristic parameter P.

The operation block 211 may calculate a changed amount of a data voltage for each data line DL on a current row line (that is, in a current horizontal period).

For example, a changed amount of a data voltage on the n-th row line (that is, the n-th horizontal period) of an m-th data line DL can be calculated by subtracting a voltage of the (n−1)-th row line from the voltage of the n-th row line.

That is, by subtracting image data (D_m, n−1) of the (n−1)-th row line from image data (D_m, n) of the n-th row line with respect to the m-th data line DL, a changed amount of a data voltage (ΔD_m, n=D_m, n−D_m, n−1) of the n-th row line can be calculated.

Here, the image data D may be image data to which a gamma voltage and polarity have been reflected.

The image data D input to the operation block 211 corresponds to gradation-based digital data for representing a gradation level. The operation block 211 may convert the received gradation-based image data D into voltage-based digital data for representing a voltage that is output from a data line DL.

Upon the data conversion, gamma correction may be performed on the received image data D to calculate the corresponding data voltage value. Also, the corresponding data voltage value may be set with a polarity according to inversion driving. For example, if a data voltage that is to be output is positive, a positive data voltage value may be set, and if a data voltage that is to be output is negative, a negative data voltage value may be set. Thereby, image data for representing a voltage that is to be actually output to the data line DL may be calculated.

As described above, the operation block 211 calculates a changed amount of a voltage for each data line DL using the image data D.

If the changed amount of the voltage for each data line DL is calculated, the operation block 211 calculates a total sum of the changed amounts of voltages for the current row line. That is, if the liquid crystal panel 110 includes first through m-th data lines DL, the operation block 211 calculates a total sum of the changed amounts of voltages for the n-th row line by calculating ΔD_n=(ΔD_1, n+ΔD_2, n+ΔD_3, n+ . . . +ΔD_M, n).

If the total sum of the changed amounts of voltages for the n-th row line is calculated, the ripple component of the common voltage Vcom may be estimated based on the total sum of the changed amounts of the voltages.

Accordingly, the operation block 211 generates common voltage data DVcom corresponding to an appropriate compensation level so that a common voltage level Vcom capable of compensating for the estimated ripple component can be output. Common voltage data according to total sums of changed amounts of voltages may be stored in the form of a lookup table.

The common voltage generator 220 outputs a compensated common voltage Vcom according to the common voltage data DVcom, thereby eliminating the ripple component.

Figure 4:
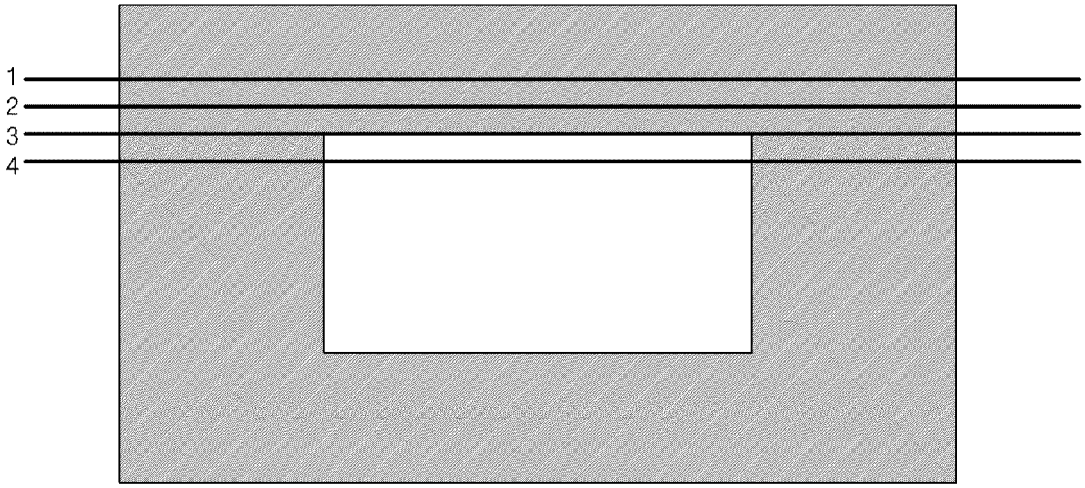
FIG. 4 shows the case where a specific pattern of image is displayed on a liquid crystal panel that is driven by a line inversion method.

This operation will be described in more detail with reference to FIGS. 4 and 5, below. FIG. 4 shows the case where a specific pattern of image is displayed on a liquid crystal panel that is driven by a line inversion method, and FIG. 5 is waveform diagrams of image data for representing the specific pattern of image of FIG. 4, an estimated common voltage ripple, and a common voltage output to compensate for the common voltage ripple.

FIG. 4 shows a specific pattern of image causing the deterioration of image quality, such as crosstalk, etc. For convenience of description, in FIG. 4, the first and second row lines all represent a 127-th gradation level which is a halftone, and the third and fourth row lines represent the 127-th gradation level in their both end portions, and a 255-th gradation level which is a brightest gradation level in their center portions.

Figure 5:
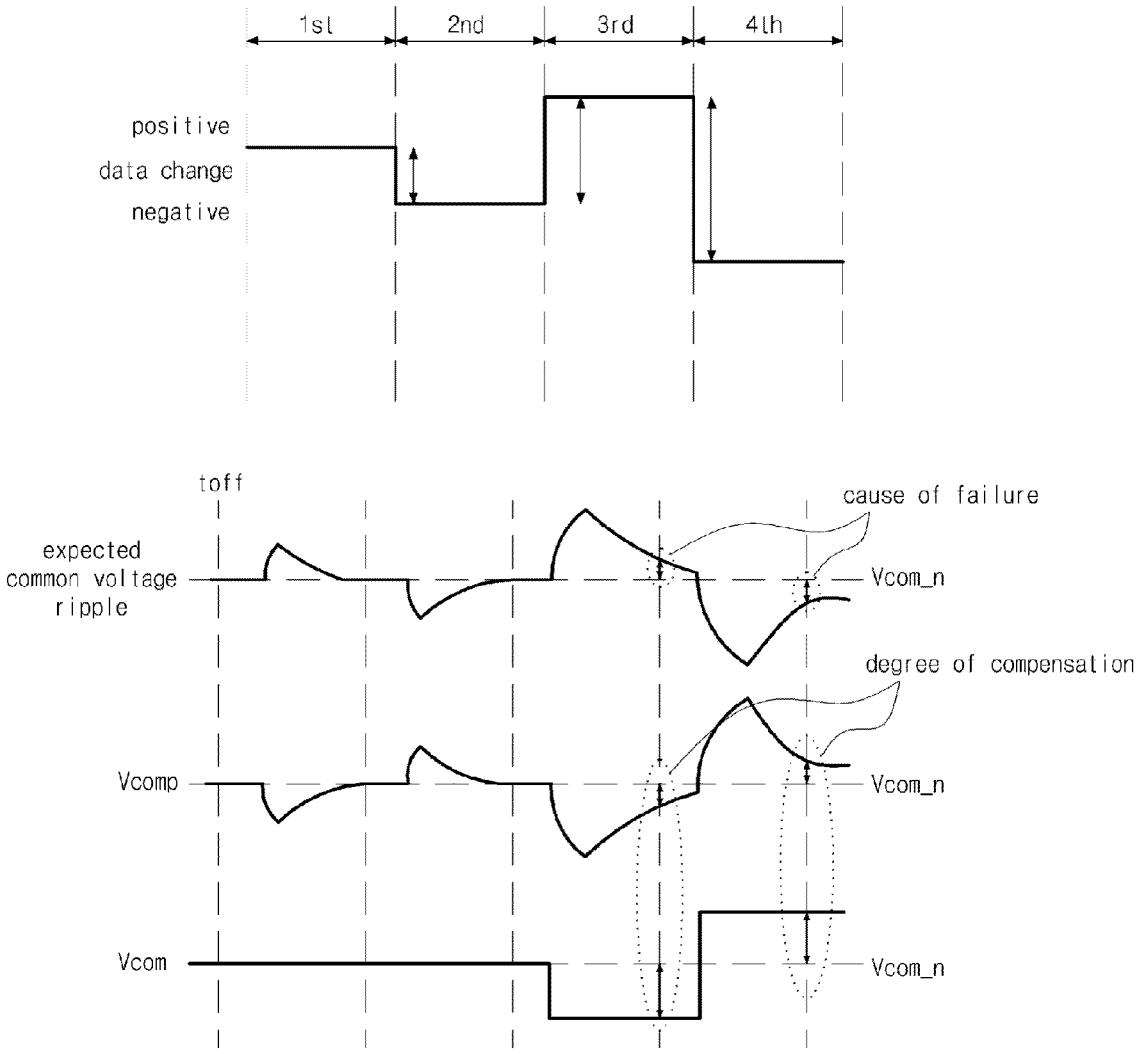
FIG. 5 is waveform diagrams of image data for representing the specific pattern of image of FIG. 4, an estimated common voltage ripple, and a common voltage output to compensate for the common voltage ripple.

FIG. 5 shows a common voltage waveform for compensating for a ripple component using a related art inverting ramp, together with the estimated common voltage ripple and the common voltage.

In the case of FIG. 4, since the changed amounts of data voltages on the first and second row lines are not relatively great, the common voltage ripples are also not great. Particularly, a common voltage of the liquid crystal panel 110 (see FIG. 1), which is estimated at a gate voltage off timing toff of a row line at which image quality deterioration occurs, reaches a normal level of common voltage Vcom_n of when no ripple is substantially generated.

Accordingly, when the first and second row lines are driven, a normal level of a common voltage Vcom_n is output instead of outputting a compensated common voltage.

However, according to the related art, since an inverting lamp is used, a common voltage whose waveform is opposite to that of a ripple component is output even when the first and second row lines are driven.

As such, in the related art, even when no image quality deterioration due to a ripple component occurs since a changed amount of data voltages is not great, the output of a common voltage changes according to the characteristic, which causes unnecessary power consumption. That is, the present disclosure can reduce consumption power compared to the related art.

Meanwhile, since the changed amounts of data voltages on the third and fourth row lines are relatively great, great common voltage ripples are generated. Particularly, a common voltage level of the liquid crystal panel 110, which is estimated at a gate voltage off timing toff at which image quality deterioration occurs, is deviated from the normal level of the common voltage Vcom_n. As such, if the ripple component does not reach the normal level even at the gate voltage off timing toff, image quality deterioration occurs.

In this case, the related art inverting lamp cannot sufficiently compensate for the ripple component at the gate voltage off timing toff, since the inverting lamp always outputs a voltage whose waveform is opposite to that of a received ripple component, due to its properties. That is, in the case where a ripple component exists at the gate voltage off timing toff, a voltage whose waveform is opposite to that of the ripple component cannot appropriately compensate for the ripple component. As a result, in the related art, deterioration of image quality occurs.

However, according to the present disclosure, by measuring the changed amounts of data voltages, the degree of a common voltage ripple that is to be generated can be estimated in advance. Accordingly, a common voltage level Vcom capable of sufficiently compensating for a ripple component that is to be generated can be output. Particularly, a high common voltage level Vcom capable of compensating for a ripple component that is generated at a gate voltage off timing toff, whose polarity is opposite to that of the ripple component at the gate voltage off timing toff, can be output. Consequently, by estimating the ripple component at the gate voltage off timing toff, image quality deterioration can be improved.

As described above, according to the present disclosure, by measuring the change amounts of data voltages on a row line, it is possible to in advance, estimate the degree of a common voltage ripple that is to be generated. Accordingly, it is possible to estimate whether a common voltage ripple component remains at a gate voltage off timing toff at which image quality deterioration occurs.

If it is estimated that a common voltage ripple remains in the gate voltage off timing toff, a common voltage Vcom changed to a common voltage level capable of sufficiently compensating for the corresponding ripple is output. Accordingly, the ripple at the gate voltage off timing toff is eliminated so that image quality deterioration can be improved.

Meanwhile, if it is estimated that no common voltage ripple remains at the gate voltage off timing toff, a normal level of a common voltage Vcom_n is output. In this way, it is possible to reduce power consumption according to the output of a common voltage. However, it is also possible that a common voltage level for compensating for a ripple component at a gate voltage on timing is output when it is estimated that no common voltage ripple remains at the gate voltage off timing toff.

Meanwhile, the output timing of the common voltage Vcom may be synchronized with the output timing of the data voltage. That is, since a changed amount of a data voltage is calculated for each row line to generate common voltage data DVcom, a common voltage Vcom can be output in synchronization with the output timing of a data voltage.

Also, a common voltage level on each row line may be maintained constant. In this case, if a ripple component needs to be compensated for, the common voltage Vcom changes to a level that is higher or lower than the normal level of the common voltage Vcom, so that the resultant common voltage Vcom has the waveform of a square wave. Unlike this, it is also possible to change a common voltage level of a row line requiring compensation of a ripple component in various forms.

As described above, the operation block 211 (see FIG. 3) generates the common voltage data DVcom according to the changed amount of the data voltage. Also, upon generation of the common voltage data DVcom, the characteristic parameter P is reflected.

Liquid crystal panels have deviations in their characteristics, and also have characteristic deviations due to their locations. Also, when the liquid crystal panel 110 (see FIG. 1) is driven, the characteristics of the liquid crystal panel 110 may change.

Accordingly, if a common voltage Vcom is generated depending on the changed amount of a data voltage, there may be the case where a ripple component is not sufficiently compensated for due to the panel's characteristics or location.

In order to overcome the problem, the common voltage data DVcom is compensated for using a characteristic parameter P for reflecting the characteristics of the liquid crystal panel 110. A plurality of characteristic parameters P may be stored in the form of a lookup table.

The characteristic parameter P is selected by the characteristic parameter block 212 of the common voltage unit 200. For example, the characteristic parameter P may be selected according to the location of a row line.

The selected characteristic parameter P is input to the operation block 211. Accordingly, the operation block 211 reflects the characteristic parameter P to the common voltage data DVcom generated based on the changed amount of the data voltage. For example, the operation block 211 may multiply the common voltage data DVcom by the characteristic parameter P to thereby compensate for the common voltage data DVcom according to the characteristics.

Meanwhile, the characteristic parameter block 212 may update the characteristic parameter P periodically. The update operation may be performed in unit of a frame.

In regard of the update operation, the characteristic parameter block 220 receives a feedback signal DF from the signal converter 230. The characteristic parameter block 220 determines whether a common voltage Vcom input to the liquid crystal panel 110 for compensating for a ripple component has properly compensated for the ripple component, based on the feedback signal DF.

Accordingly, if it is determined that the ripple component has not been properly compensated for, based on the feedback signal DF, the characteristic parameter block 220 corrects the corresponding characteristic parameter P, and stores the corrected characteristic parameter P. Meanwhile, if it is determined that the ripple component has been properly compensated for, based on the feedback signal DF, the characteristic parameter P is not corrected.

The updated characteristic parameter P may be used to generate a common voltage in the next frame. That is, a characteristic parameter P updated in the k-th frame may be used to generate a common voltage in the (k+1)-th frame.

By updating a characteristic parameter P to reflect the characteristics of a liquid crystal panel, a ripple component can be accurately compensated for.

Hereinafter, a method of generating a common voltage, according to an embodiment of the present invention, will be described.

Figure 6:
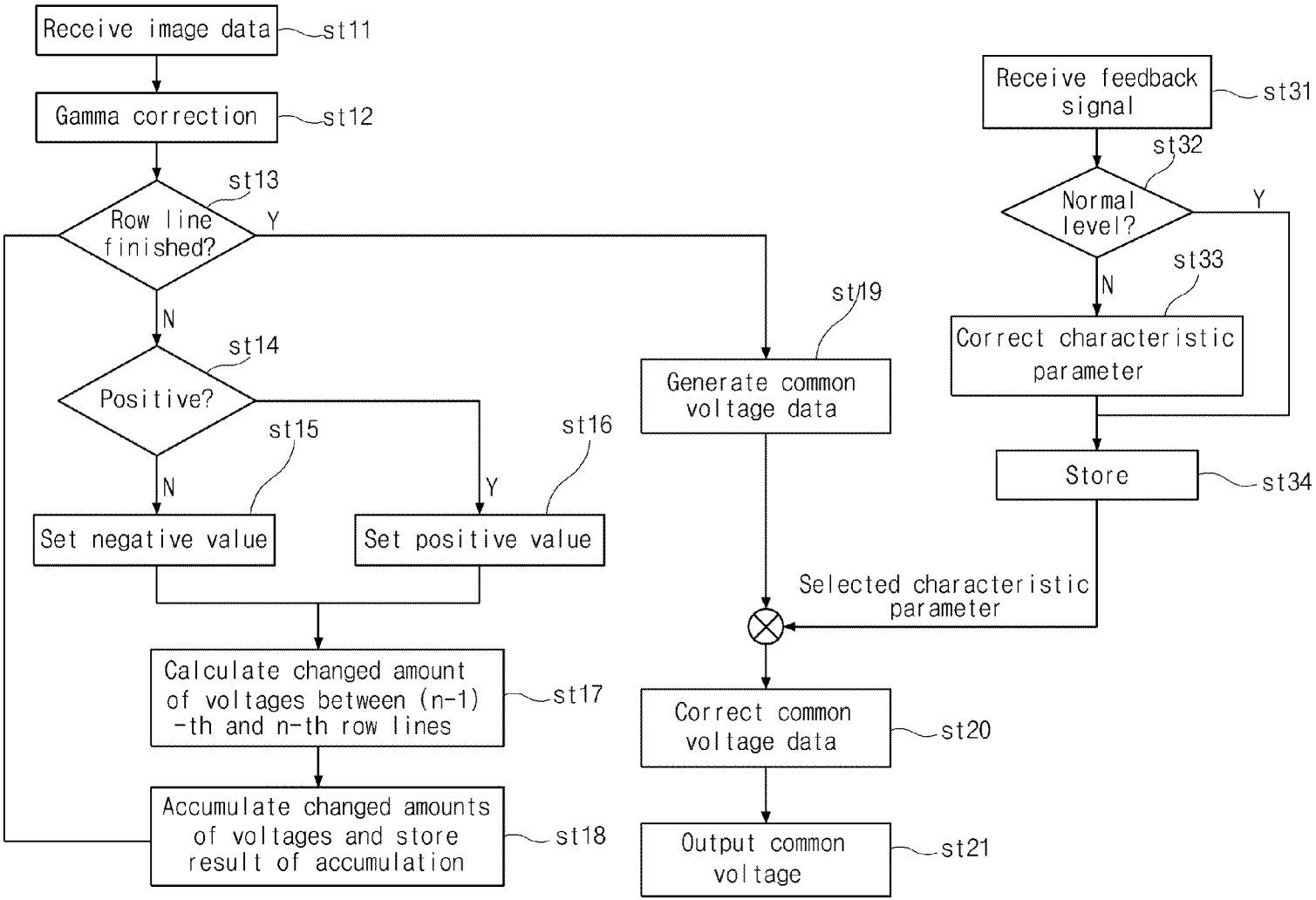
FIG. 6 is a flowchart illustrating a method of generating a common voltage, according to an embodiment of the present invention.

FIG. 6 is a flowchart illustrating a method of generating a common voltage, according to an embodiment of the present invention.

Referring to FIG. 6, image data of an n-th row line is sequentially input (st11), and gamma correction is performed on each piece of the image data (st12). Accordingly, gradation-based image data is converted into voltage-based image data.

Then, it is determined whether the n-th row line is finished (st13). The determination is made by counting the number of image data pieces of row lines.

Then, the polarity of a data voltage corresponding to the voltage-based image data is determined (st14). The determination on the polarity of the data voltage may depend on an inversion driving method.

If the data voltage is negative, a negative image data value is set (st15), and if the data voltage is positive, a positive image data value is set (st16).

Then, a changed amount of voltages between the current row line and the previous row line (that is, the (n−1)-th row line) is calculated using the image data of the current row line and the image data of the (n−1)-th row line (st17).

Then, the changed amount of the voltages is accumulated and the results of the accumulation are stored (st18).

The operation is repeated until the row line is finished, and finally, a total sum of the changed amounts of the row line is calculated.

Then, common voltage data is generated based on the total sum of the changed amounts of the voltages (st19).

Then, a characteristic parameter is reflected to the common voltage data to thereby calculate compensated common voltage data (st20). For example, a characteristic parameter corresponding to the row line is selected, the characteristic parameter is multiplied by the common voltage data, and the result of the multiplication is calculated as compensated common voltage data.

Then, a common voltage is generated based on the compensated common voltage data, and output to a liquid crystal panel (st21).

Meanwhile, the characteristic parameter for compensating for the common voltage data can be obtained by the following process.

First, a feedback signal for a common voltage is received (st31), and it is determined whether the common voltage of the liquid crystal panel has a normal level, based on the feedback signal (st32). That is, it is determined whether a common voltage of the liquid crystal panel has a normal level since the ripple component of the common voltage has been compensated for by a common voltage output from a common voltage unit to compensate for the ripple component. Particularly, since image quality deterioration depends on a common voltage level at a gate voltage off timing, it is preferable to determine whether compensation has been performed, based on a feedback signal at the gate voltage off timing.

If the common voltage does not have the normal level, this means that no compensation has been performed. In this case, the corresponding characteristic parameter is corrected (st33), and stored (st34).

If the common voltage has the normal level, this means that compensation has been performed. In this case, the corresponding characteristic parameter is stored without being corrected (st33).

The operation described above is performed for a frame, and the corresponding characteristic parameter may be updated to the characteristic parameter obtained through the operation. The updated characteristic parameter may be used to output a common voltage in the next frame.

Therefore, according to the embodiments as described above, by calculating a changed amount of a data voltage on a row line, it is possible to in advance, estimate the degree of a common voltage ripple. Accordingly, if it is estimated that a common voltage ripple remains at a gate voltage off timing, a common voltage changed to a level capable of sufficiently compensating for the ripple component can be output.

Furthermore, since a common voltage can be compensated for using a characteristic parameter representing the characteristics of a liquid crystal panel, a ripple component can be more accurately compensated for.

Accordingly, it is possible to effectively remove a ripple at a gate voltage off timing, thereby improving deterioration of image quality.

It will be apparent to those skilled in the art that various modifications and variations can be made in a display device of the present disclosure without departing from the sprit or scope of the invention. Thus, it is intended that the present invention covers the modifications and variations of this invention provided they come within the scope of the appended claims and their equivalents.

What is claimed is:

1. A driving method of a liquid crystal display device that is driven by an inversion method, the driving method comprising:

calculating a total sum of changed amounts of data voltages between an (n−1)-th row line and an n-th row line, using image data of the (n−1)-th row line and image data of the n-th row line;

estimating a ripple component of a common voltage at a gate voltage off timing of the n-th row line based on the total sum of the changed amounts of the data voltages;

generating common voltage data according to the estimated ripple component of the common voltage;

reflecting a characteristic parameter of a liquid crystal panel into the common voltage data; and generating a common voltage according to the common voltage data to which the characteristic parameter is reflected into, and outputting the common voltage to the liquid crystal panel, wherein when it is estimated that no ripple component exists at the gate voltage off timing, the common voltage data corresponding to a normal level of a common voltage is generated for an entire output timing of the data voltage to the n-th row line until the gate voltage off timing, wherein when it is estimated that the ripple component exists at the gate voltage off timing, the common voltage data corresponding to a level of a common voltage capable of compensating for the ripple component is generated that reflects the characteristic parameter at the gate voltage off timing, the generated level of the common voltage having a polarity that is opposite to that of the ripple component at the gate voltage off timing, wherein the common voltage data corresponding to the level of the common voltage capable of compensating for the ripple component is generated for a period of time so that the gate voltage off timing occurs at an intermediate point of time during the period of time, and wherein the common voltage data corresponding to a level of a common voltage that is capable of compensating for the ripple component is a level of the common voltage that is higher or lower than the normal level of the common voltage.

2. The driving method according to claim 1, further comprising:

determining whether the common voltage of the liquid crystal panel has the normal level, based on a common voltage feedback signal from the liquid crystal panel;

correcting the characteristic parameter and storing the corrected characteristic parameter if the common voltage of the liquid crystal panel does not have the normal level, and storing the characteristic parameter if the common voltage of the liquid crystal panel has the normal level, thereby updating characteristic parameter information; and compensating for common voltage data of a next frame, using the updated characteristic parameter information.

3. The driving method according to claim 1, wherein the characteristic parameter is a parameter that reflects characteristics of the liquid crystal panel and characteristics of the corresponding row line.

4. The driving method according to claim 2, further comprising:

converting the common voltage feedback signal from the liquid crystal panel into a digital feedback signal, wherein whether the common voltage of the liquid crystal panel has the normal level is determined, based on the digital feedback signal.

5. The driving method according to claim 1, wherein the calculating of the total sum of the changed amounts of the data voltages between the (n−1)-th row line and the n-th row line comprises:

performing gamma correction on the image data of the (n−1)-th row line and the image data of the n-th row line, and assigning polarities to the gamma-corrected image data according to the inversion method, thereby converting the gamma-corrected image data into image data representing voltages;

calculating a changed amount of data voltages between the converted image data of the (n−1)-th and n-th row lines, for each data line; and summing changed amounts of data voltages calculated for all data lines, thereby calculating the total sum of the changed amounts of the data voltages.

6. The driving method according to claim 1, wherein an output timing of the common voltage is synchronized with an output timing of the data voltage of the n-th row line.

7. The driving method according to claim 6, wherein while the data voltage of the n-th row line is output, the level of the common voltage is maintained constant.

8. A liquid crystal display device which is driven by an inversion method, the liquid crystal display device comprising:

an operation block configured to calculate a total sum of changed amounts of data voltages between an (n−1)-th row line and an n-th row line, using image data of the (n−1)-th and n-th row lines, to estimate a ripple component of a common voltage at a gate voltage off timing of the n-th row line based on the total sum of the changed amounts of the data voltages, to generate common voltage data according to the estimated ripple component of the common voltage, and to reflect a characteristic parameter of a liquid crystal panel into the common voltage data;

a characteristic parameter block configured to supply the characteristic parameter to the operation block; and a common voltage generator configured to generate a common voltage according to the common voltage data to which the characteristic parameter is reflected into, and to output the common voltage to the liquid crystal panel, wherein when it is estimated that no ripple component exists at the gate voltage off timing, the common voltage data corresponding to a normal level of a common voltage is generated for an entire output timing of the data voltage to the n-th row line until the gate voltage off timing, wherein when it is estimated that the ripple component exists at the gate voltage off timing, the common voltage data corresponding to a level of a common voltage capable of compensating for the ripple component is generated that reflects the characteristic parameter at the gate voltage off timing, the generated level of the common voltage having a polarity that is opposite to that of the ripple component at the gate voltage off timing, wherein the common voltage data corresponding to the level of the common voltage capable of compensating for the ripple component is generated for a period of time so that the gate voltage off timing occurs at an intermediate point of time during the period of time, and wherein the common voltage data corresponding to a level of a common voltage that is capable of compensating for the ripple component is a level of the common voltage that is higher or lower than the normal level of the common voltage.

9. The liquid crystal display device according to claim 8, wherein the characteristic parameter block determines whether the common voltage of the liquid crystal panel has the normal level, based on a common voltage feedback signal from the liquid crystal panel, corrects the characteristic parameter and stores the corrected characteristic parameter if the common voltage of the liquid crystal panel does not have the normal level, and stores the characteristic parameter if the common voltage of the liquid crystal panel has the normal level, thereby updating characteristic parameter information, and wherein the operation block compensates for common voltage data of a next frame using the updated characteristic parameter information.

10. The liquid crystal display device according to claim 8, wherein the characteristic parameter is a parameter that reflects characteristics of the liquid crystal panel and characteristics of the corresponding row line.

11. The liquid crystal display device according to claim 9, further comprising:

a signal converter configured to convert the common voltage feedback signal from the liquid crystal panel into a digital feedback signal, wherein the characteristic, parameter block determines whether the common voltage of the liquid crystal panel has the normal level, based on the digital feedback signal.

12. The liquid crystal display device according to claim 8, wherein the operation block performs gamma correction on the image data of the (n−1)-th and n-th row lines, assigns polarities to the ganuna-corrected image data according to the inversion method, thereby converting the gamma-corrected image data into image data representing voltages, calculates a changed amount of data voltages between the converted image data of the (n−1)-th and n-th row lines, for each data line, and sums changed amounts of data voltages calculated for all data lines, thereby calculating the total sum of the changed amounts of the data voltages.

13. The liquid crystal display device according to claim 8, wherein an output timing of the common voltage is synchronized with an output timing of the data voltage of the n-th row line.

14. The liquid crystal display device according to claim 13, wherein while the data voltage of the n-th row line is output, the level of the common voltage is maintained constant.

* * * * *

UNITED STATES PATENT AND TRADEMARK OFFICE

CERTIFICATE OF CORRECTION

PATENT NO. : 9,324,284 B2
APPLICATION NO. : 13/728780
DATED : April 26, 2016
INVENTOR(S) : Kyung-Rok Kim et al.

It is certified that error appears in the above-identified patent and that said Letters Patent is hereby corrected as shown below:

ON THE TITLE PAGE:

Please insert the following:

-- (30) Foreign Application Priority Data

Sep. 28, 2012 (KR) ..... 10-2012-0108873 --.

Signed and Sealed this
Twenty-sixth Day of July, 2016

Michelle K. Lee

Michelle K. Lee
*Director of the United States Patent and Trademark Office*